US011417956B2

(12) United States Patent
Lin et al.

(10) Patent No.: US 11,417,956 B2
(45) Date of Patent: Aug. 16, 2022

(54) PARASITIC ELEMENTS FOR ANTENNA SYSTEMS

(71) Applicant: PCTEL, Inc., Bloomingdale, IL (US)

(72) Inventors: Jesse Lin, Lisle, IL (US); Robert Gunnels, Homer Glen, IL (US)

(73) Assignee: PCTEL, Inc., Bloomingdale, IL (US)

( * ) Notice: Subject to any disclaimer, the term of this patent is extended or adjusted under 35 U.S.C. 154(b) by 0 days.

(21) Appl. No.: 17/084,109

(22) Filed: Oct. 29, 2020

(65) Prior Publication Data

US 2022/0140481 A1 May 5, 2022

(51) Int. Cl.

| | |
|---|---|
| ***H01Q 9/16*** | (2006.01) |
| ***H01Q 19/00*** | (2006.01) |
| ***H01Q 5/385*** | (2015.01) |
| ***H01Q 5/392*** | (2015.01) |
| ***H01Q 25/00*** | (2006.01) |

(52) U.S. Cl.

CPC ..... *H01Q 5/385* (2015.01); *H01Q 5/392* (2015.01); *H01Q 25/002* (2013.01)

(58) Field of Classification Search

CPC ..... H01Q 5/38; H01Q 5/385; H01Q 5/39; H01Q 5/392; H01Q 25/00; H01Q 25/002; H01Q 1/38; H01Q 9/16; H01Q 5/37; H01Q 5/378

See application file for complete search history.

(56) References Cited

U.S. PATENT DOCUMENTS

| | | | | |
|---|---|---|---|---|
| 4,700,197 | A * | 10/1987 | Milne | H01Q 3/446 343/837 |
| 5,629,713 | A * | 5/1997 | Mailandt | H01Q 1/246 343/792.5 |
| 5,767,807 | A * | 6/1998 | Pritchett | H01Q 3/24 342/374 |
| 6,211,840 | B1 | 4/2001 | Wood et al. | |
| 8,836,600 | B2 * | 9/2014 | Lafleur | H01Q 1/362 343/833 |
| 9,196,959 | B1 * | 11/2015 | Doane | H01Q 3/446 |
| 9,941,595 | B2 | 4/2018 | Yang et al. | |
| 11,005,191 | B1 | 5/2021 | Gunnels | |
| 2002/0158808 | A1 | 10/2002 | Inoue | |
| 2004/0070545 | A1 | 4/2004 | Ikeda et al. | |
| 2009/0073072 | A1 * | 3/2009 | Lindenmeier | H01Q 1/3275 343/810 |
| 2011/0050529 | A1 * | 3/2011 | Popugaev | H01Q 9/045 343/833 |
| 2017/0047665 | A1 | 2/2017 | Yang et al. | |
| 2021/0135376 | A1 | 5/2021 | Gunnels | |

OTHER PUBLICATIONS

European Search Report issued for European Patent Application No. 21188630.4 dated Jan. 20, 2022.

* cited by examiner

*Primary Examiner* — Tho G Phan

(74) *Attorney, Agent, or Firm* — Husch Blackwell LLP

(57) ABSTRACT

An antenna system is provided that can include a plurality of parasitic elements connected to and extending from a ground plane, wherein each of the plurality of parasitic elements can be oriented at a common pitch angle, wherein each of the plurality of parasitic elements can be positioned at a uniform distance from a center of an antenna disposed on the ground plane, and wherein a respective length of each of the plurality of parasitic elements, the common pitch angle, and/or the uniform distance can be optimized so as to broaden a beamwidth of a radiation pattern produced by the antenna.

14 Claims, 4 Drawing Sheets

PARASITIC ELEMENTS FOR ANTENNA SYSTEMS

FIELD

The present invention generally relates to radio frequency (RF) communications hardware. More particularly, the present invention relates to antenna systems.

BACKGROUND

In many global navigation satellite system ("GNSS") antenna applications, it is beneficial for a radiation pattern of an antenna to have a broad beamwidth. In particular, it is beneficial for the antenna to provide hemispheric coverage centered about the zenith and for a gain of the antenna to be as high as possible near the horizon without significant gain loss at or near the zenith while maintaining the gain as low as possible below the horizon.

However, known antenna systems that provide the above-identified features suffer from several known drawbacks. For example, some known antenna systems provide the broad beamwidth by employing an antenna element with a large height dimension that is not suitable for applications requiring antennas with low physical profiles. Furthermore, other known antenna systems require the use of resistors, capacitors, and/or inductors to create a loading circuit. Regardless, all of these known antenna systems require a large volume or additional loading components to implement and only broaden the beamwidth by a small degree.

In view of the above, there is a continuing, ongoing need for improved antenna systems.

DETAILED DESCRIPTION

Figure 1:
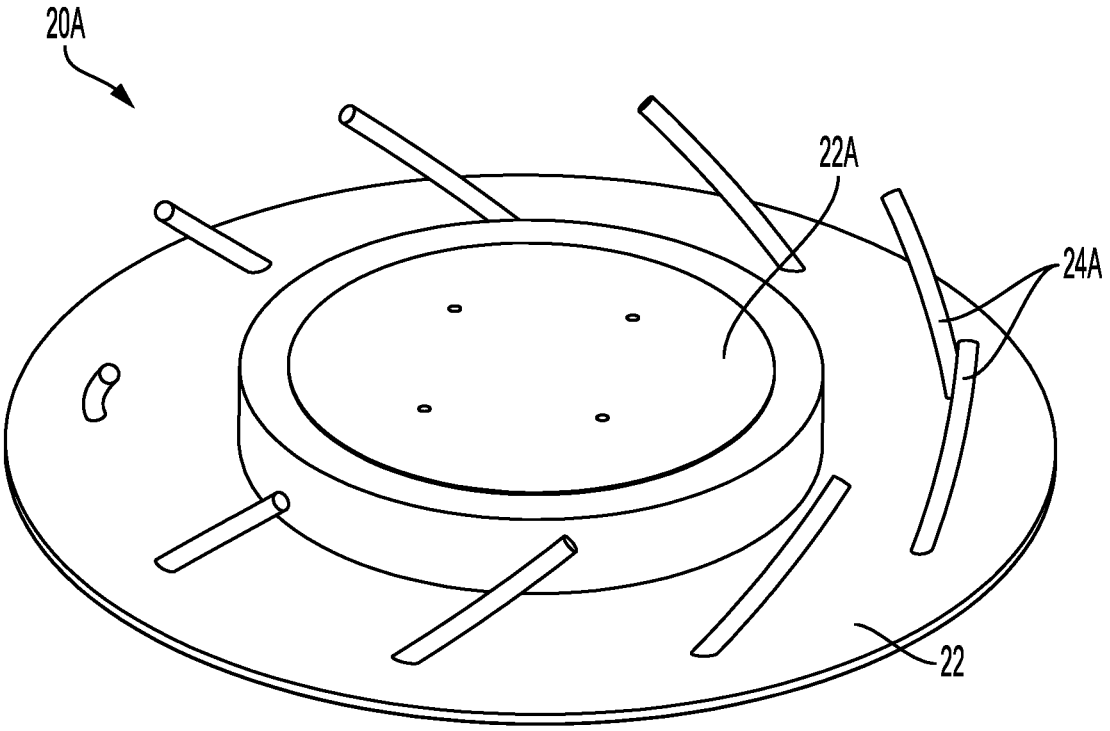
FIG. 1 is a perspective view of an antenna system according to disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein can include an antenna system that can produce a radiation pattern with a broad beamwidth, hemispheric coverage centered about the zenith, and a gain as high as possible near the horizon without significant gain loss at or near the zenith while maintaining the gain as low as possible below the horizon.

In some embodiments, the antenna system disclosed herein can include a ground plane, an antenna disposed on a top side of the ground plane and configured to produce a radiation pattern, and a plurality of parasitic elements connected or coupled to and extending from the top side of the ground plane and positioned around the antenna. For example, in some embodiments, a respective proximate end of each of the plurality of parasitic elements can be connected to the ground plane, and a respective distal end of each of the plurality of parasitic elements can be displaced from the ground plane.

In some embodiments, each of the plurality of parasitic elements can be positioned at a uniform distance from a center of the antenna, and in some embodiments, each of the plurality of parasitic elements can be oriented at a common pitch angle relative to the ground plane. However, in any embodiment, a respective length of each of the plurality of parasitic elements, the common pitch angle, and/or the uniform distance can be optimized in order to broaden a beamwidth of the radiation pattern. For example, in some embodiments, the uniform distance can be equal to one quarter of a wavelength ($\lambda/4$) of a frequency of the antenna. Additionally or alternatively, in some embodiments, the respective length of each of the plurality of parasitic elements can be between approximately 0.2 and approximately 0.25 times the wavelength of the frequency of the antenna. Additionally or alternatively, in some embodiments, the common pitch angle can be between approximately 35° and approximately 55°, and in some embodiments, the common pitch angle can be approximately 45°.

In some embodiments, the plurality of parasitic elements can include any number of elements as would be known by one of ordinary skill in the art, for example, between 6 and 16 elements. Additionally or alternatively, in some embodiments, a respective top section of each of the plurality of parasitic elements can be bent downwards or inwards towards the ground plane to reduce a respective height of each of the plurality of parasitic elements relative to the ground plane.

In some embodiments, the plurality parasitic elements can be shaped and oriented in a manner that is appropriate for and/or complementary to a polarization of the antenna's radiation. For example, in embodiments in which the radiation is right hand circularly polarized (RHCP), the plurality of parasitic elements can include helical-shaped elements, and the respective distal end of each of the plurality of parasitic elements can extend in a counter-clockwise direction relative to the respective proximate end of a respective one of the plurality of parasitic elements. Alternatively, in embodiments in which the radiation is left hand circularly polarized (LHCP), the plurality of parasitic elements can include helical-shaped elements, and the respective distal end of each of the plurality of parasitic elements can extend in a clockwise direction relative to the respective proximate end of the respective one of the plurality of parasitic elements. However, embodiments disclosed herein are not so limited and can include additional or alternative embodiments in which, for example, the plurality of parasitic elements can be vertical and/or the plurality of parasitic elements can include non-curving, straight elements.

FIG. 1 is a perspective view of an antenna system 20A according to disclosed embodiments. As seen in FIG. 1, in some embodiments, the antenna system 20A can include a ground plane 22, a patch antenna 22A disposed on a top side of the ground plane 22, and a plurality of parasitic elements 24A connected or coupled to and extending from the top side of the ground plane 22 such that a respective proximal end of each of the plurality of parasitic elements 24A can be connected to the ground plane 22 and a respective distal end of each of the plurality of parasitic elements 24A can be displaced from the ground plane 22. As also seen in FIG. 1, in some embodiments, the patch antenna 22A can be fed with four probes that are assigned with a 90° degree phase progression and a same amplitude. It is to be understood that the patch antenna 22A can be designed to be either LHCP or RHCP, but the patch antenna 22A in FIG. 1 is RHCP.

As seen in FIG. 1, in some embodiments, the plurality of parasitic elements 24A can include metal wire elements that can be placed in an equidistant manner around the patch antenna 22A at a uniform distance from a center of the patch antenna 22A and with a common pitch angle relative to the ground plane 22. In particular, a respective length of each of the plurality of parasitic elements 24A, the common pitch angle, and the uniform distance can be optimized in order to broaden a beamwidth of a radiation pattern produced by the patch antenna 22A. For example, in embodiments in which the common pitch angle is 45°, the plurality of parasitic elements 24A can divide the antenna's 22A radiation into two orthogonally crossed electric fields: a first of the electric fields that is parallel to the plurality of parasitic elements 24A and a second of the electric fields that is perpendicular to the plurality of parasitic elements 24A. In these embodiments, each of the plurality of parasitic elements 24A can be excited by the first of the electric fields that is parallel to the plurality of parasitic elements 24A. Furthermore, when the distance between the center of the patch antenna 22A and each of the plurality of parasitic elements 24A is λ/4 of a frequency of the patch antenna 22A, a reflection of the second of the electric fields that is perpendicular to the plurality of parasitic elements 24A can be canceled without an additional loading circuit to do so. As such, the above-identified interaction between the plurality of parasitic elements 24A and the first of the electric fields that is parallel to the plurality of parasitic elements 24A can achieve a 90° phase difference between first and second components of the radiation produced by the antenna system 20A, thereby establishing circular polarization that is equivalent to a polarization of the patch antenna 22A.

Additional or alternative embodiments for both the antenna 22A and the plurality of parasitic element 22A are contemplated. For example, FIG. 2, FIG. 3, FIG. 4, and FIG. 5 are perspective views of antenna systems 20B, 20C, 20D, and 20E, respectively, according to disclosed embodiments.

Figure 2:
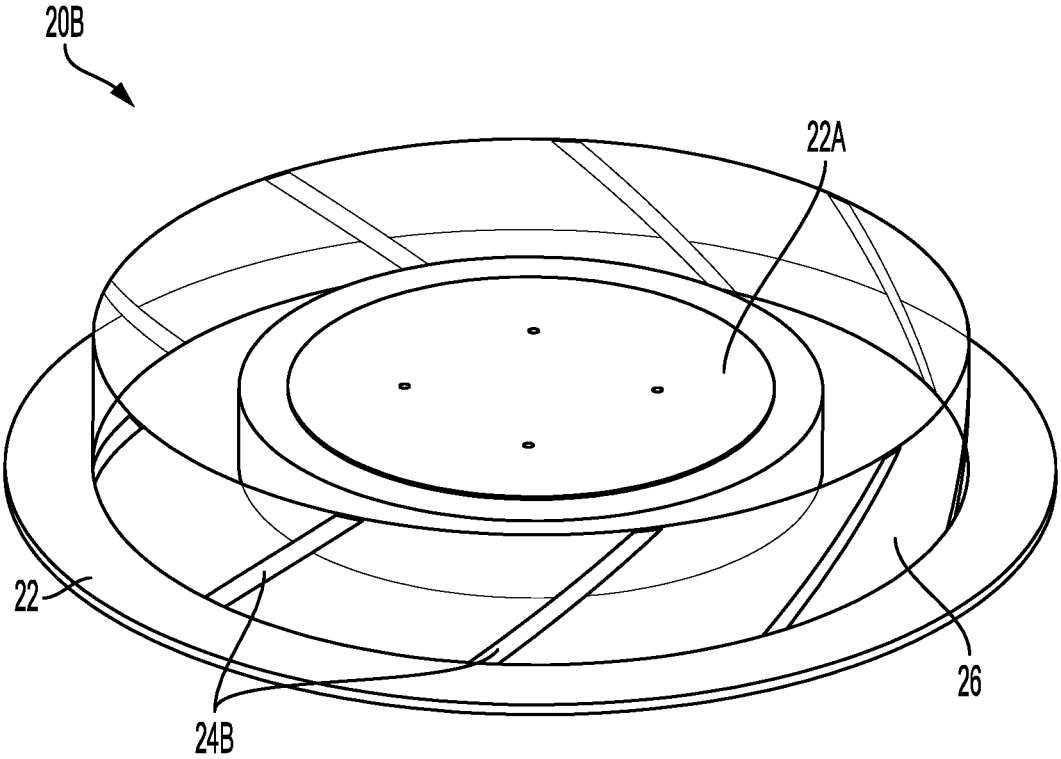
FIG. 2 is a perspective view of an antenna system according to disclosed embodiments.

The antenna system 20B of FIG. 2 is similar to the antenna system 20A of FIG. 1 except that the plurality of parasitic elements 24A can be replaced with a plurality of parasitic elements 24B, which can include copper strips embedded in a cylindrical printed circuit board. In these embodiments, the antenna system 20B can also include a second printed circuit board on top of the plurality of parasitic elements 24B, with top portions of the copper strips included in the second printed circuit board.

Figure 3:
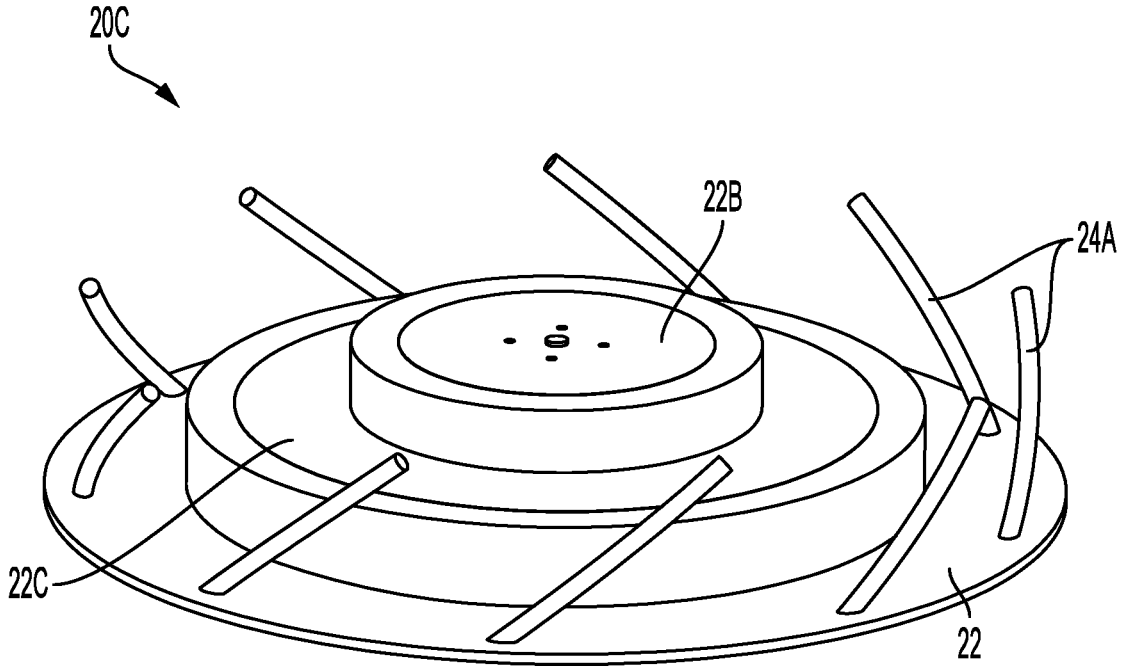
FIG. 3 is a perspective view of an antenna system according to disclosed embodiments.
Figure 4:
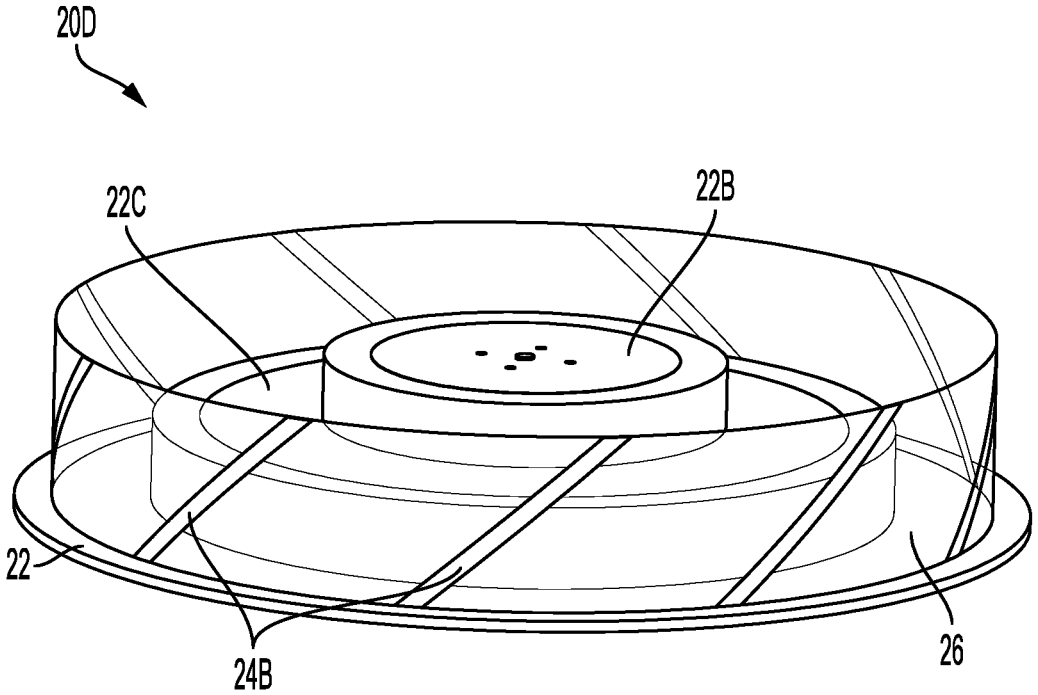
FIG. 4 is a perspective view of an antenna system according to disclosed embodiments.

Furthermore, the antenna system 20C of FIG. 3 is similar to the antenna system 20A of FIG. 1 and the antenna system 20D of FIG. 4 is similar to the antenna system 20B except that the single patch antenna 22A can be replaced with a high band patch antenna 22B and a low band patch antenna 22C. As in the above-identified embodiments, in these embodiments, the respective length of each of the plurality of parasitic elements 24A and/or 24B, the common pitch angle of each of the plurality of parasitic elements 24A and/or 24B, and/or the uniform distance between centers of the high band patch antenna 22B and the low band patch antenna 22C can be optimized in order to broaden the beamwidth of one or both of the radiation pattern produced by the low band patch antenna 22C and the radiation pattern produced by the high band patch antenna 22B, albeit with balanced improvement in the beamwidth due a dual-band design.

Figure 5:
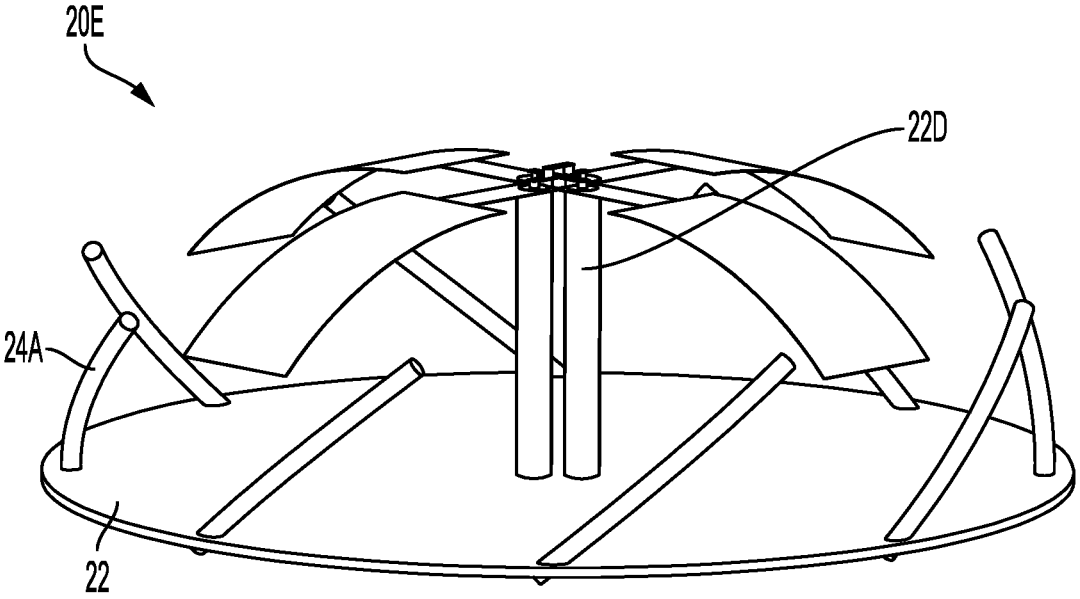
FIG. 5 is a perspective view of an antenna system according to disclosed embodiments.

Further still, the antenna system 20E of FIG. 5 is similar to the antenna systems 20A, 20B, 20C, and 20D of FIG. 1, FIG. 2, FIG. 3, and FIG. 4, respectively, except that the single patch antenna 22A, the high band patch antenna 22B, and/or the low band patch antenna 22C can be replaced with a circularly polarized crossed-dipole antenna 20D. Although not illustrated, it is to be understood that the antenna systems 20A, 20B, 20C, 20D, and/or 20E could include, additionally or alternatively, a monopole antenna, a helix antenna, or any other geometry as would be known by one or ordinary skill in the art and can include a single band, dual-band, or multi-band elements.

Figure 6:
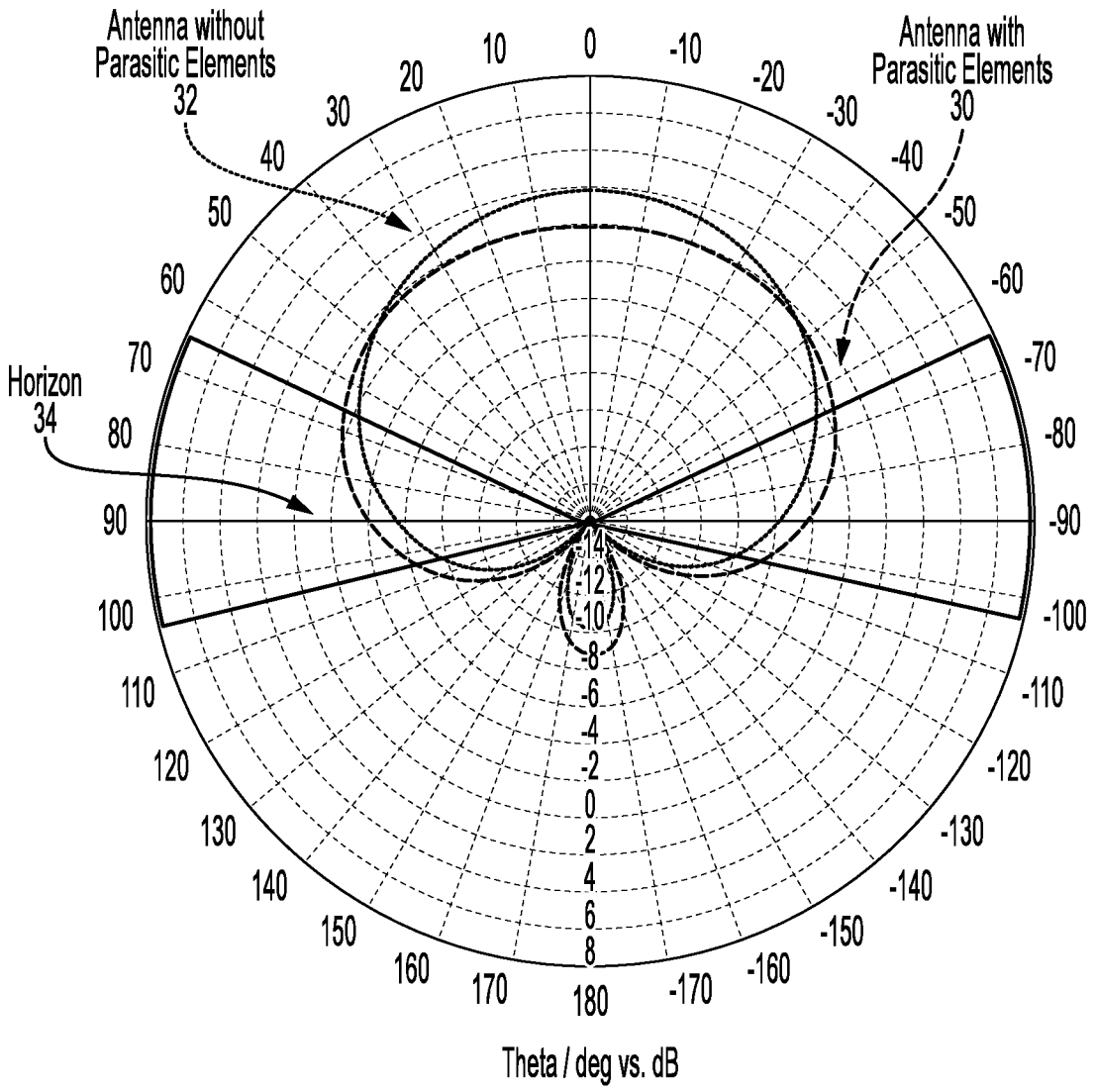
FIG. 6 is a graph of a radiation pattern for an antenna system according to disclosed embodiments.

FIG. 6 is a graph of a radiation pattern 30 for the antenna system 20A, 20B, 20C, 20D, and/or 20E according to disclosed embodiments. As seen in FIG. 6, without the plurality of parasitic elements 24A and/or 24B, the single patch antenna 22A, the high band patch antenna 22B, and/or the low band patch antenna 22C can produce a radiation pattern 32 with a 3 dB beamwidth at only 90°-100°. However, when the plurality of parasitic elements 24A and/or 24B are used in connection with the single patch antenna 22A, the high band patch antenna 22B, and/or the low band patch antenna 22C as disclosed herein, the antenna system 20A, 20B, 20C, 20D, and/or 20E can broaden the 3 dB beamwidth to approximately 150°-160° and increase a gain at low elevation angles close to the horizon 34 by approximately 2 dB, thereby producing the radiation pattern 30.

Although a few embodiments have been described in detail above, other modifications are possible. For example, other components may be added to or removed from the described systems, and other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. An antenna system comprising:

a ground plane;

an antenna disposed on a top side of the ground plane and configured to produce a radiation pattern; and a plurality of parasitic elements connected to and extending from the top side of the ground plane, wherein a respective proximal end of each of the plurality of parasitic elements is connected to the ground plane, wherein a respective distal end of each of the plurality of parasitic elements is displaced from the ground plane, wherein each of the plurality of parasitic elements is positioned at a uniform distance from a center of the antenna, the uniform distance being equal to approximately one quarter of a wavelength (λ/4) of a frequency of the antenna, wherein each of the plurality of parasitic elements is oriented at a common pitch angle relative to the ground plane, the common pitch angle being between approximately 35° and approximately 55°, and wherein a respective length of each of the plurality of parasitic elements, the common pitch angle, and the uniform distance are optimized so as to broaden a beamwidth of the radiation pattern.

2. The antenna system of claim 1 wherein the common pitch angle is 45°.

3. The antenna system of claim 1 wherein a respective length of each of the plurality of parasitic elements is between approximately 0.2 and approximately 0.25 times a wavelength of a frequency of the antenna.

4. The antenna system of claim 1 wherein the plurality of parasitic elements includes metal wire elements.

5. The antenna system of claim 1 wherein the plurality of parasitic elements includes copper strips embedded in a printed circuit board.

6. The antenna system of claim 1 wherein the plurality of parasitic elements includes between 6 and 16 elements.

7. The antenna system of claim 1 wherein each the plurality of parasitic elements is placed in an equally spaced manner around the antenna.

8. The antenna system of claim 1 wherein the antenna includes one or more patch antennas.

9. The antenna system of claim 1 wherein the antenna includes a crossed-dipole antenna.

10. The antenna system of claim 1 wherein the antenna includes one or more single band elements.

11. The antenna system of claim 1 wherein the antenna includes a dual-band element or a multi-band element.

12. The antenna system of claim 1 wherein each of the plurality of parasitic elements is shaped and oriented in a manner that is complementary to a polarization of the antenna's radiation.

13. The antenna system of claim 12 wherein the antenna polarization is circularly polarized, and wherein the plurality of parasitic elements includes helical-shaped elements.

14. The antenna system of claim 1 wherein a respective top section of each of the plurality of parasitic elements is bent down towards the ground plane.

* * * * *